US005145556A

United States Patent [19]

Westerberg et al.

[11] Patent Number: 5,145,556

[45] Date of Patent: Sep. 8, 1992

[54] SINGLE-STAGE SLAKING AND CAUSTICIZING METHOD

[75] Inventors: J. Lennart Westerberg, Mobile, Ala.; Alex K. Bonsu, Greeley, Pa.; Fred J. Perrett, Demopolis, Ala.

[73] Assignee: International Paper Company, Purchase, N.Y.

[21] Appl. No.: 738,651

[22] Filed: Jul. 31, 1991

[51] Int. Cl.[5] ..... D21C 11/00

[52] U.S. Cl. ..... 162/29; 162/30.11; 162/43; 162/44; 162/45; 423/DIG. 3

[58] Field of Search ..... 423/432, DIG. 3; 162/29, 30.1, 30.11, 43, 44, 45

[56] References Cited

U.S. PATENT DOCUMENTS

| | | | |
|---|---|---|---|
| 2,539,732 | 1/1951 | Donohue | 423/DIG. 3 |
| 3,194,638 | 7/1965 | Neuville | 422/228 |
| 3,210,235 | 10/1965 | Ferrigan | 423/DIG. 3 |

*Primary Examiner*—W. Gary Jones
*Assistant Examiner*—Brenda Lamb
*Attorney, Agent, or Firm*—Michael J. Doyle; Walt Thomas Zielinski

[57] ABSTRACT

A one-step slaking/causticizing method for producing white liquor from unslaked lime and clarified green liquor comprising introducing a feed slurry of unslaked lime and clarified green liquor into a pressurized slaker/causticizer reaction zone and maintaining the mixture in the zone at a temperature, under sufficient pressure and for a time sufficient, in one step to slake the lime and to convert the slaked lime to a white liquor containing product slurry.

8 Claims, 2 Drawing Sheets

SINGLE-STAGE SLAKING AND CAUSTICIZING METHOD

BACKGROUND OF THE INVENTION

1. Field of the Invention

The present invention relates to an improved method for producing white liquor by a combined slaking and causticizing operation.

2. Description of the Prior Art

In conventional methods for alkaline pulping of cellulosic materials, the slaking of the lime and subsequent causticization of the green liquor is accomplished in separate units, each specially designed to carry out a single step of the process. Thus, strong green liquor is fed to a lime slaker-classifier unit where it is mixed with and slakes a measured flow of lime. The resultant mix of lime flows to a classifier section for removal of coarse grit and unreacted material by means of a conveyor or rake-like device moving up the inclined bottom of the classifier tank. The degritted slurry overflows from the slaker-classifier into a series of tanks in which it is agitated and the causticizing reaction, already started in the slaker, is completed. The causticized slurry then passes to a clarifier where the precipitated lime mud is separated out and is usually pumped to a thickener for recovery. The strong white liquor removed from the clarifier is then ready for use in cooking.

One serious disadvantage of the conventional slaking-causticizing system is the tendency for portions of the reacting slurry to overflow from one stage to the next without being retained in a particular reaction zone for the full time intended. This short-circuiting or bypassing of relatively unreacted chemicals is relatively inefficient and does not utilize the available chemicals to the best advantage.

Various combined pressurized slaker/causticizing systems have been proposed; however, none have proven sufficiently cost-effective or efficient to replace the conventional two-stage systems.

One such combined system employs a slaker with an air lock to remove grits. The system, however, does not satisfactorily resolve the problem of grits removal.

Another system utilizes a system wherein the reactor is maintained under pressure, but wherein the slaker and causticizer are unpressurized. These units operate at very low efficiency and have not found widespread acceptance in the industry.

U.S. Pat. No. 2,539,732 discloses a process for slaking and causticizing lime in a single unit. In the causticizer unit, lime (CaO) is introduced concurrently with green liquor. The lime is slaked and then gently mixed with the green liquor in a series of reaction trays to complete the causticizing. The unit can be used in cases where the lime (solid) is in suspension in a liquid (green liquor) before introduction into the unit. The unit is provided with a plurality of trays and scraper/agitator means for moving solid material from one tray to the next lower tray. The patented system does not provide, however, for an efficient removal of grits and other solids from the various product and intermediate liquors.

U.S. Pat. No. 3,194,638 relates to a combined slaker/-causticizer. Again, the problem of efficient grit removal is not adequately addressed.

U.S. Pat. No. 4,627,888 discloses high pressure slaking followed by atmospheric pressure causticizing, whereas U.S. Pat. No. 4,762,590 discloses a process wherein both the slaking and causticizing can be performed at elevated pressure. However, the latter patent discloses slaking lime with white liquor rather than with green liquor.

The present invention provides a single-stage slaking-/causticizing system which provides for an essentially one-step slaking and causticizing operation for the efficient and cost-effective production of white liquor which drastically reduces the number of separate apparatuses required in conventional systems and which provides for the complete removal of grits and other contaminating solids from the white liquor.

SUMMARY OF THE INVENTION

Figure 1:
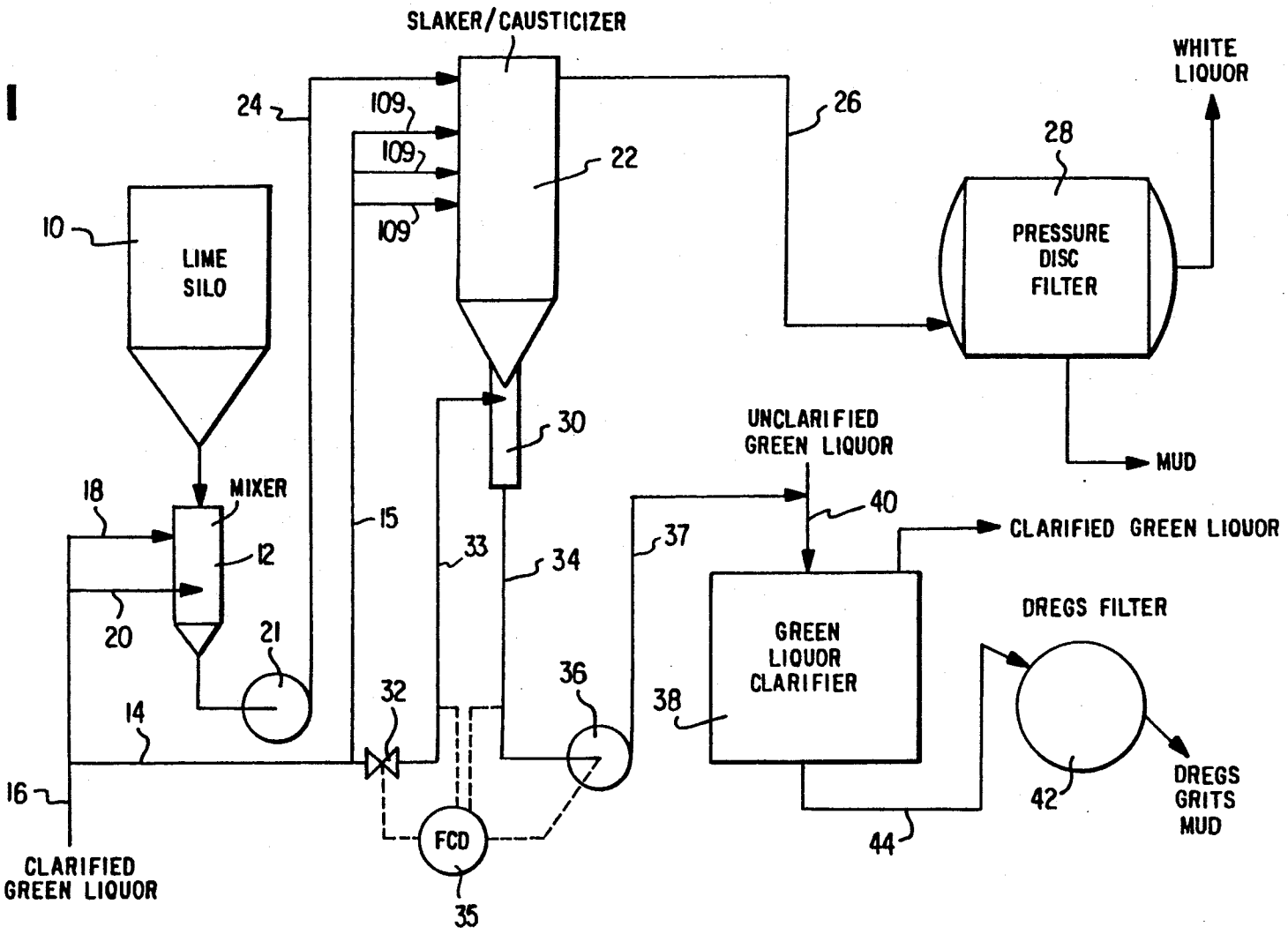
FIG. 1 depicts a flow sheet of the single-stage slaking/causticizing method of the invention.

There is provided, according to the present invention, an improved one-step slaking/causticizing method for producing white liquor from unslaked lime and clarified green liquor comprising introducing a feed slurry of unslaked lime and clarified green liquor into a pressurized slaker/causticizer reaction zone and maintaining the mixture of unslaked lime and clarified green liquor in the zone at a temperature, under sufficient pressure and for a time sufficient, in one step to slake the unslaked lime and to convert the slaked lime by reaction with the clarified green liquor to a white liquor containing product slurry.

DETAILED DESCRIPTION OF THE INVENTION

According to the method of the present invention, the problem of grits removal, which has consistently plagued the art, is solved while simultaneously greatly reducing the cost of the operation and increasing its efficiency and cost-effectiveness.

Grits removal is accomplished in a closed system which also provides for efficient dregs and mud removal.

Slaking and causticizing are accomplished in a closed system under pressure, substantially eliminating emissions to the atmosphere. The pressurized system also minimizes retention time and the number and size of equipment needed. The combined slaking and causticizing under pressure eliminates heat losses to the atmosphere and increases white liquor causticity by 4% from the atmospheric optimum.

Slaking and causticizing are accomplished using minimum agitation to minimize particle degradation to improve the filterability of lime mud.

In addition, in a preferred embodiment, the green liquor is fed into the combination slaker/causticizer in different proportions and at different locations, thereby optimizing particle size formation and causticizing efficiency.

In another preferred embodiment, the method of the invention includes the step of withdrawing the white liquor containing the product slurry from the slaker/-causticizer zone and clarifying the product to produce clarified white liquor.

In still another preferred embodiment, the method of the invention includes the step of withdrawing grits and a portion of the white liquor containing the product slurry from the slaker/causticizer reaction zone and admixing the grits and a portion of the white liquor containing the product slurry with clarified green liquor and blending the admixture with unclarified green liquor in a green liquor clarifying zone, wherein clarified green liquor is separated from particulate matter contained therein substantially comprising dregs, mud and grits.

In yet another preferred embodiment of the method of the invention, at least a portion of the clarified green liquor is recycled for introduction into the slaker/causticizer zone.

An additional preferred embodiment of the invention includes the step of introducing into the slaker/causticizer clarified green liquor in addition to that contained in the feed slurry.

It will be understood by those skilled in the art that the method of the invention may be carried out in a continuous manner, i.e., by continuously introducing a feed slurry of unslaked lime and clarified green liquor into a pressurized slaker/causticizer reaction zone and maintaining the mixture of unslaked lime and clarified green liquor in the zone at a temperature and under sufficient pressure and for a sufficient time, in one step to slake the unslaked lime and to convert the slaked lime by reaction with the clarified green liquor to a white liquor containing the product slurry. At the same time continuously withdrawing a portion of the white liquor containing the product slurry from the zone. This makes it possible to continuously withdraw grits and a portion of the white liquor containing the product slurry from the zone. Also at the same time, continuously admixing the grits and the portion of the white liquor containing the product slurry with clarified green liquor. This mixture is continuously blended with unclarified green liquor in a green liquor clarifying zone. Grits and dregs are withdrawn therefrom and filtered on a dregs filter.

The invention will be further explained with reference to the drawings.

The method of the invention is illustrated in the flow sheet depicted in FIG. 1. Reburned lime (CaO) is fed from lime hopper 10 to mixer 12 wherein it is mixed with clarified green liquor recycled from a subsequent step or supplied independently of the process via line 16. Preferably, the green liquor is fed into the mixer at multiple locations, e.g., via lines 18 and 20, for optimum mixing with lime. After complete mixing, the mixture is fed via pump 21 to the combined slaker/causticizer 22 via line 24. Retention time in the mixer 12, pump 21 and line 24 is preferably less than one minute, thereby ensuring substantially no reaction between the lime and the green liquor until the mixture reaches the reactor 22. Hereinafter, the slaker/causticizer 22 is referred to as the white liquor generator (WLG).

The WLG 22 is fed by a slurry of green liquor ($Na_2CO_3+Na_2S$) and lime ($CaO+CaCO_3$) and clarified green liquor via lines 14 and 15. The active chemicals in the reaction are ($H_2O+Na_2CO_3$) in the green liquor and (CaO) in the lime. In a slaking/causticizing operation, the reaction takes place in two stages. First, slaking occurs when calcium oxide (CaO) reacts with the water in the green liquor to form calcium hydroxide ($Ca[OH]_2$) with the evolution of heat according to the reaction:

$$CaO+H_2O \rightarrow Ca(OH)_2+\text{Heat}$$

The second reaction occurs when the $Ca(OH)_2$ reacts with the sodium carbonate ($Na_2CO_3$) in the green liquor to form sodium hydroxide (NaOH) and calcium carbonate ($CaCO_3$) precipitate, i.e., the causticizing reaction:

$$Ca(OH)_2+Na_2CO_3 \rightleftharpoons 2NaOH+CaCO_3$$

Although written in two stages, the reactions actually overlap and occur substantially in one step in that part of the causticizing occurs almost simultaneously with the slaking. The green liquor temperature and lime temperature going to the mixer is normally 195° F.–200° F. for the liquor and 500° F.–1,400° F. for the lime, depending on the lime kiln configuration. The temperature in the WLG will be 235° F. and the pressure 8 psi when the feed liquor temperature is 195° F. and the lime temperature is 500° F. At 195° F. and 1,400° F., respectively, the temperature in the generator will be 257° F. and the pressure 17 psi.

Upon completion of the reaction in WLG 22, the slurry is transported via line 26 to filter 28, e.g., a pressure disc filter where the $CaCO_3$ (mud) is separated from the clarified white liquor product which is suitable for use in the cellulose pulping process without further treatment.

Retention time in the WLG 22 is about one hour compared to about three hours in a conventional system operated at atmospheric pressure.

Grits (coarse unreacted particles) are removed from the bottom of generator WLG 22 together with a portion (e.g., 0.5%–2.0%) of the product slurry and mixed in mixer 30 with clarified green liquor (5–15% of the total amount of the green liquor fed to WLG 22) supplied by line 33 through valve 32, controlled by flow control device 35. From flow measuring sensors (not shown), the flow in each of lines 33 and 34 is measured. This information is fed to FCD 35 which, in turn, controls valve 32 and pump 36 to maintain a desired flow rate in each of lines 33 and 34. The dashed lines indicate the path of electrical signals between the sensors in lines 33 and 34 and valve 32 and pump 36 and flow control device 35. Such control equipment and arrangements are well known in this art. The mixture is fed via line 34 to variable speed pump 36 and from there through lines 37 to line 40 where it is blended with unclarified green liquor going to green liquor, clarifier 38. Grits and dregs will settle in the clarifier 38 from where they are pumped to a dregs precoat filter 42 via line 44 for thickening and washing. Mixing lime mud and grits with the unclarified green liquor enhances the settling of the dregs in the clarifier and the washing on the precoat filter. Optionally grits can be removed from the slurry in a separate device, e.g., a slaker.

Figure 2:
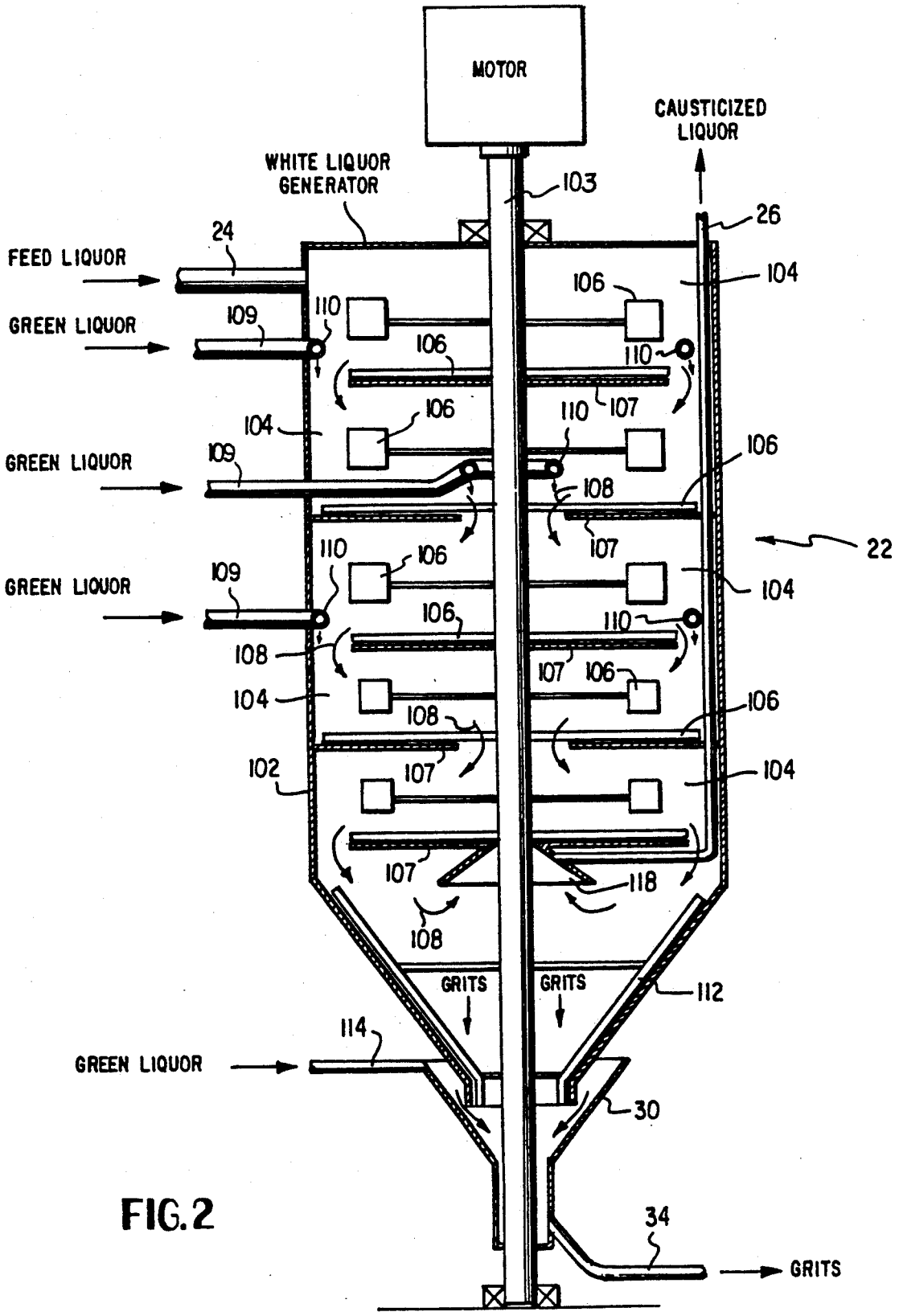
FIG. 2 is a cross-section in axial direction representation of the slaker/causticizer depicted in FIG. 1.

The WLG 22 is depicted in detail in FIG. 2. The WLG is a stacked tower 102 with four to eight vertically disposed compartments 104 sufficiently agitated by agitators 106 in the form of paddles and scrapers, including lowermost scraper 112. A variable speed agitator motor mounted (by brackets not shown) at the top of 22 is coupled to and rotates vertically disposed shaft 103 to which agitators and scrapers 106 and scraper 112 are attached. The agitator scraping the bottom of each compartment 104 moves unreacted lime to the outer circumference on every other bottom and to the middle of the other bottoms, where openings allow for a downward flow (indicated by arrows 108) of unreacted and reacted lime with the liquor. Each compartment bottom is defined by a horizontal plate 107. The illustrated second and fourth plates 107, counting from the top, are supported by brackets (not shown) extending from their respective outer edges to the inside wall of 22. A central opening in each permits shaft 103 to extend therethrough.

Inlet pipes 109 (see also FIG. 1) pass through the wall of 22 and terminate at headers 110. This allows for green liquor to be split fed at various compartments 104. Each header is designed for 30–50% of the total flow. The feed slurry is fed to the WLG via line 24. Each circular header 110 is of 360 degrees angular extent, with each having a plurality of openings to discharge the green liquor downwardly as indicated by the straight arrows.

At the bottom of the WLG, agitator 112 scrapes the sides of the WLG and keeps mud particles in suspension while grits settle (as shown by the two arrows) and then mix with green liquor in outlet device 30. This device is designed as a circular nozzle feeding into the outlet pipe 34 going to the green liquor clarifier inlet. Green liquor may also be introduced via line 114.

Causticized liquor and mud leave the WLG through a cone 118 attached to the lowest place plate 107 and an inside pipe which leads to line 26. The pipe is located where it acts as a baffle to enhance agitation. The cone and the pipe are inside teflon coated to eliminate build up.

Conventional control devices and means (not shown) such as variable pumps and variable speed agitators are provided to control the flow of green liquor to the mixer 12, the level therein, differential flow control of green liquor underflow, flow control of green liquor to the WLG, the level therein and the speed of the agitator.

What is claimed is:

1. A one-step slaking/causticizing method for producing white liquor from unslaked lime and clarified green liquor comprising introducing a feed slurry of unslaked lime and clarified green liquor into a pressurized slaker/causticizer reaction zone and maintaining said mixture of unslaked lime and clarified green liquor in said zone at a temperature, under sufficient pressure and for a time sufficient, in one step to slake said unslaked lime and to convert said slaked lime by reaction with said clarified green liquor to a white liquor containing product slurry; withdrawing grits and a portion of the white liquor containing product slurry from said slaker/causticizer reaction zone and admixing said grits and a portion of the white liquor containing product slurry withdrawn from said slaker/causticizer reaction zone with clarified green liquor, blending said admixture with unclarified green liquor in a green liquor clarifying zone wherein clarified green liquor is separated from particulate matter contained therein substantially comprising dregs, mud and grits.

2. The method of claim 1 including the step of withdrawing said white liquor containing product slurry from said slakêr/causticizer zone and clarifying said product to produce clarified white liquor.

3. The method of claim 1 wherein at least a portion of said clarified green liquor is recycled from the green liquor clarifying zone for introduction into said slaker/causticizer zone.

4. The method of claim 1 including the step of introducing into said slaker/causticizer, clarified green liquor in addition to that contained in said feed slurry.

5. The process of claim 1 wherein the pressure in said slaker/caustizer reaction zone is above atmospheric.

6. A continuous process for producing white liquor from unslaked lime and clarified green liquor comprising continuously introducing a feed slurry of unslaked lime and clarified green liquor into a pressurized slaker/causticizer reaction zone and maintaining said mixture of unslaked lime and clarified green liquor in said zone at a temperature, under sufficient pressure and for a time sufficient, in one step to slake said unslaked lime and to convert said slaked lime by reaction with said clarified green liquor to a white liquor containing product slurry, continuously withdrawing at least a portion of said white liquor containing product slurry from said zone, continuously withdrawing grits and a portion of said white liquor containing product slurry from said slaker/causticizer reaction zone, continuously admixing said withdrawn grits and portion of the white liquor containing product slurry with clarified green liquor, continuously blending said admixture with unclarified green liquor in a green liquor clarifying zone, withdrawing clarified green liquor therefrom and recycling it for introduction into said slaker/causticizer zone.

7. The method of claim 6 including the step of clarifying said portion of white liquor containing product slurry withdrawn from said zone to produce clarified white liquor.

8. The process of claim 6 wherein the pressure in said slaker/caustizer reaction zone is above atmospheric.

* * * * *